United States Patent [19]

Grosshuesch

[11] Patent Number: 4,513,907

[45] Date of Patent: Apr. 30, 1985

[54] VENTILATED FRUIT FLY PROOF PRODUCE SHIPPER

[75] Inventor: Lee V. Grosshuesch, Kaneohe, Hi.

[73] Assignee: Weyerhaeuser Company, Tacoma, Wash.

[21] Appl. No.: 517,488

[22] Filed: Jul. 26, 1983

[51] Int. Cl.[3] ..... B65D 13/04

[52] U.S. Cl. ..... 229/23 R; 217/40; 217/42; 229/DIG. 14

[58] Field of Search ..... 229/6 A, 23 R, DIG. 14; 43/107, 119, 132.1; 428/907; 217/40, 42

[56] References Cited

U.S. PATENT DOCUMENTS

| | | | |
|---|---|---|---|
| 536,506 | 3/1895 | Boatwright | 217/42 |
| 876,061 | 1/1908 | Katzenstein | 217/40 |
| 1,697,709 | 1/1929 | Bliss | 229/23 R |
| 1,838,726 | 12/1931 | Workman | 217/40 |
| 2,401,742 | 6/1946 | Bentham | 229/23 R X |
| 2,745,593 | 5/1956 | Brady | 229/DIG. 14 |
| 3,040,954 | 6/1962 | Salmon | 229/23 R |
| 3,507,667 | 4/1970 | Magnen | 229/DIG. 14 |

FOREIGN PATENT DOCUMENTS

| | | | |
|---|---|---|---|
| 367335 | 10/1906 | France | 217/42 |
| 1102855 | 10/1955 | France | 229/6 A |
| 17044 | 7/1897 | United Kingdom | 217/40 |

*Primary Examiner*—William T. Dixson, Jr.
*Assistant Examiner*—Gary E. Elkins

[57] ABSTRACT

A container for preventing fruit flies from depositing eggs in fruit within the container. At least one pair of walls are formed of at least two laminations of corrugated board. Vent holes are formed in this pair of walls and screen is across these vent holes and between the laminations. The mesh size of the screen and the width of the inner laminations prevent the ovipositor of the fly from depositing eggs within the fruit.

24 Claims, 7 Drawing Figures

Fig. 1
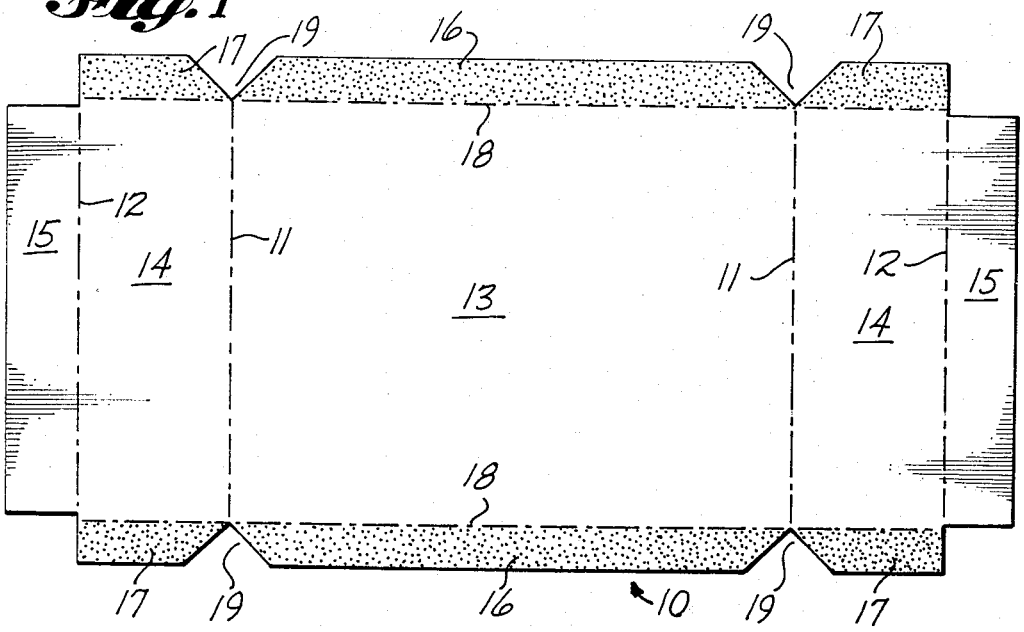
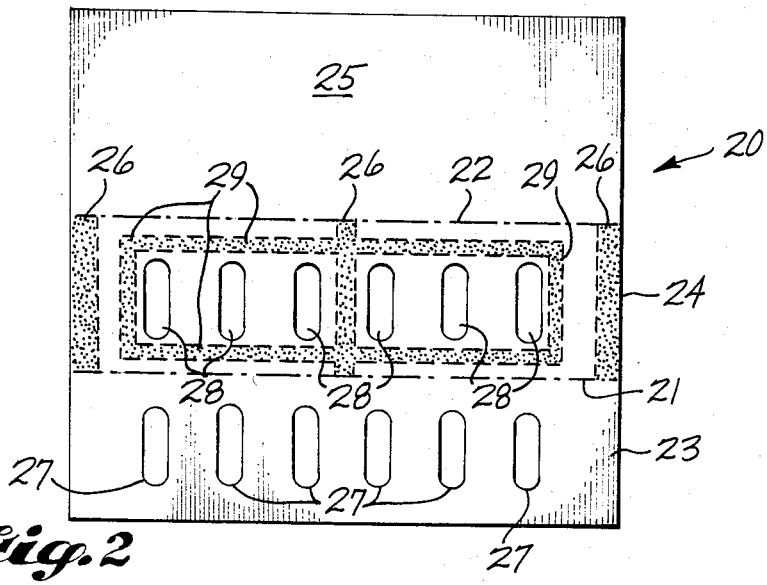
Fig. 2
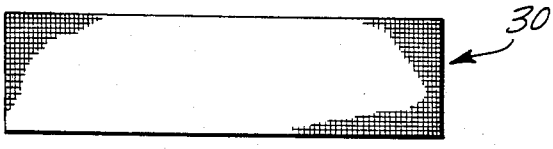
Fig. 3

VENTILATED FRUIT FLY PROOF PRODUCE SHIPPER

BACKGROUND OF THE INVENTION

The recent Mediterranean fruit fly incident illustrated a problem that exists in this country—the possibility of shipping infested fruit throughout the country and causing colonies of fruit flies to appear in uninfested areas. The Mediterranean fruit fly is one of a number of fruit flies which can infest different kinds of fruit.

The life cycle is the same for each type of fly. The female fruit fly has an ovipositor at the end of its abdomen which is inserted into a host fruit. Barbs at the base of the ovipositor hold the ovipositor to the fruit surface while the eggs are laid within the fruit. The eggs hatch within the fruit and the larva use the fruit as a food supply. The adult flies emerge from the fruit, mate and new eggs are laid within the new host fruit. If the fruit has been transported from one location to another, then the fruit flies will emerge and propagate in the new location if suitable host fruit can be found.

This is presumably what happened in the recent Mediterranean fruit fly incident in which it was thought that a host fruit was carried from Hawaii to California. There the adult fruit flies emerged and found new and different host fruit in which to lay eggs. A concern was that the cycle would repeat itself throughout the country.

The fruit flies will lay eggs both in fruit on the tree and in picked fruit in containers, if they have access to the latter fruit. For this reason, the fruit is normally packed in fully enclosed containers, such as a fully enclosed regular slotted container or fully enclosed telescopic half slotted container or fully enclosed containers of the types shown in Du Barry U.S. Pat. No. 3,434,648 granted Mar. 25, 1969 and Chaffers U.S. Pat. No. 3,946,934 granted Mar. 30, 1976. Another type of fully enclosed container, a large tray which has a telescoping cover is shown in Putnam U.S. Pat. No. 3,940,053 granted Feb. 24, 1976.

It would be preferrable to have a container with adequate ventilation to prevent premature ripening, to improve ventilation and cooling, and to allow for the escape of the ethylene gas produced by the fruit. Many fruits, such as avocados, must be ventilated during shipment and storage. Such a ventilated container is shown in Chaffers U.S. Pat. No. 3,713,579 granted Jan. 30, 1973. Unfortunately, the ventilation holes will allow the fruit fly to lay eggs within the fruit.

The Putman and Chaffers patents also disclose corrugated containers with laminated walls.

The ovipositor is not a single element. It has three elements or sections. These are shown diagramatically in FIG. 7. In this figure the ovipositor is shown in its extended position. The segment VII is next to the abdomen D. It houses segment VIII and pat of segment IX, and has barbs on its outer face for holding the ovipositor in the fruit. Segment VIII is a membraneous telescoping sheath which has chitinous slides or guides which slide telescopically into and out of segment VII. This action is hydraulic using the body fluids of the fly and a pumping action to pump the guides and segment IX into the fruit. If segment IX extends further than segment VIII allows, then segment IX is without support and the ovipositor is useless.

The eggs are deposited from the outer tip segment IX but segment VIII must penetrate the fruit if this is to happen.

The ovipositor shown in FIG. 7 is not to scale. The length of ovipositors of flies have been measured by D. E. Hardy. His 1974 monograph "The Fruit Flies of the Philippines" Pacific Insects Monograph 32:1-266, Bernice P. Bishop Museum, Honolulu, Hawaii lists the mean length and standard deviation of the ovipositor and its individual segments. These are based on the measurements of 100 ovipositors for each of three species of laboratory reared fruit flies, and for wild fruit flies. These are given in Table I.

TABLE I

| | Laboratory | | | | | | | | Wild | | | |
|---|---|---|---|---|---|---|---|---|---|---|---|---|
| | VII | | VIII | | IX | | OP | | VII | VIII | IX | OP |
| Species | ML | SD | ML | SD | ML | SD | ML | SD | ML | ML | ML | ML |
| *C. capitata* | 1.0 | 0.07 | 1.1 | 0.10 | 1.1 | 0.05 | 3.2 | 0.12 | — | — | — | — |
| *D. cucurbitae* | 1.5 | 0.10 | 2.6 | 0.14 | 1.6 | 0.06 | 5.6 | 0.20 | 1.5 | 1.9 | 1.6 | 5.0 |
| *D. dorsalis* | 1.1 | 0.05 | 1.9 | 0.14 | 1.5 | 0.12 | 4.5 | 0.12 | 1.2 | 1.6 | 1.5 | 4.3 |

Laboratory = Laboratory-reared flies
Wild = Wild flies
VII = Segment VII
VIII = Segment VIII
IX = Segment IX
OP = Ovipositor
ML = Mean length, mm
SD = Standard deviation, mm The longest ovipositor is that of the melon fly which has a length of 5.8 mm and a standard deviation of 0.20 mm.

A study by the Hawaiian Fruit Flies Laboratory in 1978 indicated that the penetration of the fruit by the ovipositor will depend upon the ripeness or maturity of the fruit. The fly has more difficulty penetrating an unripe or harvest mature fruit than penetrating a ripe fruit. An experiment was performed using Brazilian bananas. The mean depth of puncture was for C. capitata 1.9 mm in unripe bananas and 2.4 mm in ripe bananas; for D. cucurbitae 3.3 mm in unripe bananas and 5.2 mm in ripe bananas; and for D. dorsalis 2.1 mm in unripe bananas and 3.5 mm in ripe bananas.

SUMMARY OF THE INVENTION

The problem was brought to the inventor by a customer. Both recognized that screen wire has been used to prevent insects from gaining access to a space. It was also recognized that this was a special case because of two factors. First, screen wire placed on the inside of the container would not be effective because it would not stop the insect ovipositors from penetrating the fruit lying against the screen. Second, screen on the exterior of the container would be subject to damage and possible removal during transportation and movement of the individual containers.

The inventor then determined that it would be possible to both keep the screen away from the exterior sidewall where it would be subject to damage and removal and also place the screen at a distance from the fruit so that the flies would not have access to it. The vent holes would be placed in panels of the container that were of two or more laminations of corrugated board. The screen would be placed between the laminations and across the vent holes. The outer laminations would prevent damage to or removal of the screen. The inner lamination or laminations are of a width that would prevent the flies from depositing eggs within the fruit. This would provide a ventilated, fly-proof and damage-resistant container.

He also determined that there must be a relationship between the width of the vents, the thickness or depth of the interior board between the screen and the fruit, and the size of the fruit being packaged. The fruit can bulge into the vent and be closer to the screen than the depth of the interior board. The width of the vent hole will determine how close the fruit will get to the screen. The fruit must remain a distance from the screen that will prevent the flies depositing eggs in the fruit. Consequently, the width of the vent will be determined both by the size of the fruit and by the depth of the interior board.

He determined that a screen wire would be most easily placed in a bliss style container having separate sidewalls which are attached by flaps to the bottom and end walls. This allows the side walls to be laminated separately and the screen to be placed within the side walls during the laminating operation prior to forming the container.

BRIEF DESCRIPTION OF THE DRAWINGS

FIG. 1 is a top plan view of a body blank.

FIG. 2 is a top plan view of a side wall blank.

FIG. 3 is a top plan view of a screen.

DESCRIPTION OF THE PREFERRED EMBODIMENT

Figure 5:
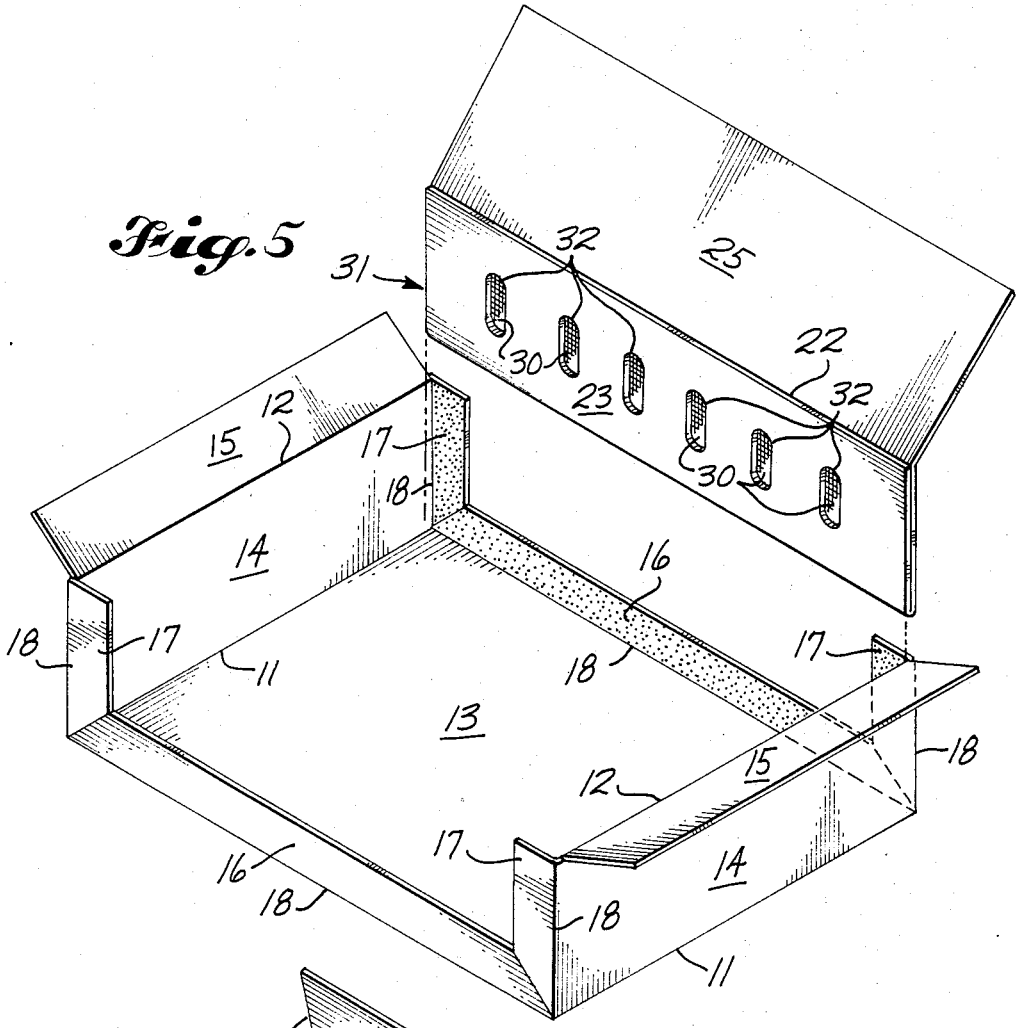
FIG. 5 is an isometric view showing the sidewalls being attached to the body blank.

The body blank 10 is divided by score lines 11 and 12 into a bottom panel 13, first side panels 14, and first closure panels 15. Bottom attachment flaps 16 and side attachment flaps 17 are attached to bottom panel 13 and first side panels 14, respectively, along score lines 18. The attachment flaps are notched at 19. The attachment flaps 16 and 17 have glue on this inner face.

Side wall blank 20 is divided by score lines 21 and 22 into an inner side panel 23, an outer side panel 24 and a side closure panel 25. The outer side panel 24 has vertical glue lines 26 on its inner face. These glue lines adhere the inner and outer side panels 23 and 24 together. The inner and outer side panels 23 and 24 have a series of vent holes—vent holes 27 in the inner side panel 23, and vent holes 28 in the outer side panel 24. Each of the vent holes 27 will be congruent with its opposite vent hole 28 when the side panels 23 and 24 are laminated together.

The outer side panel 24 also has a rectangular glue line 29 on its inner face. The latter glue line is positioned around the outer perimeter of the vent holes and will attach the screen wire 30, shown in FIG. 3, to the side wall 24 between the inner and outer side walls 23 and 24. Tapes may be used in place of the glue line 29 to tape the screen 30 onto the inner face of the side wall 24.

Figure 4:
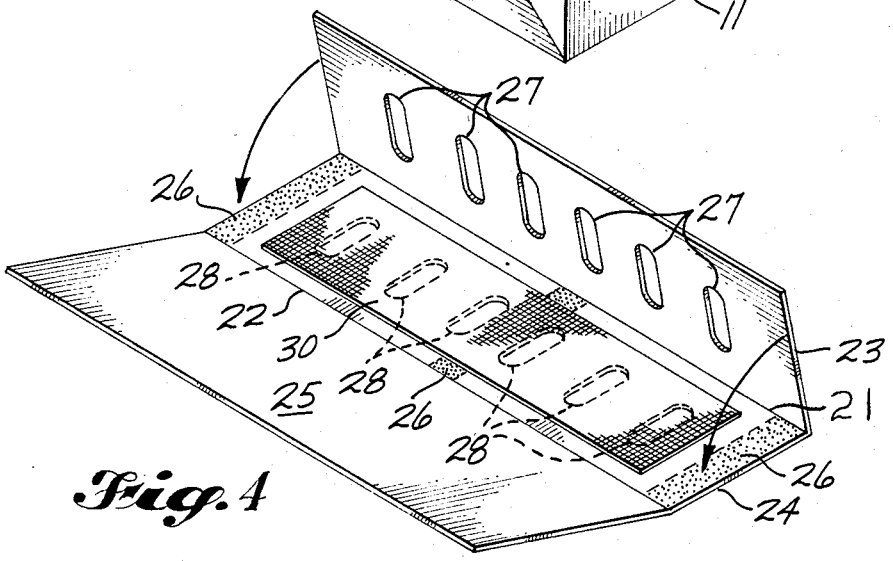
FIG. 4 is an isometric view showing the screen being placed within the laminations of a sidewall.
Figure 6:
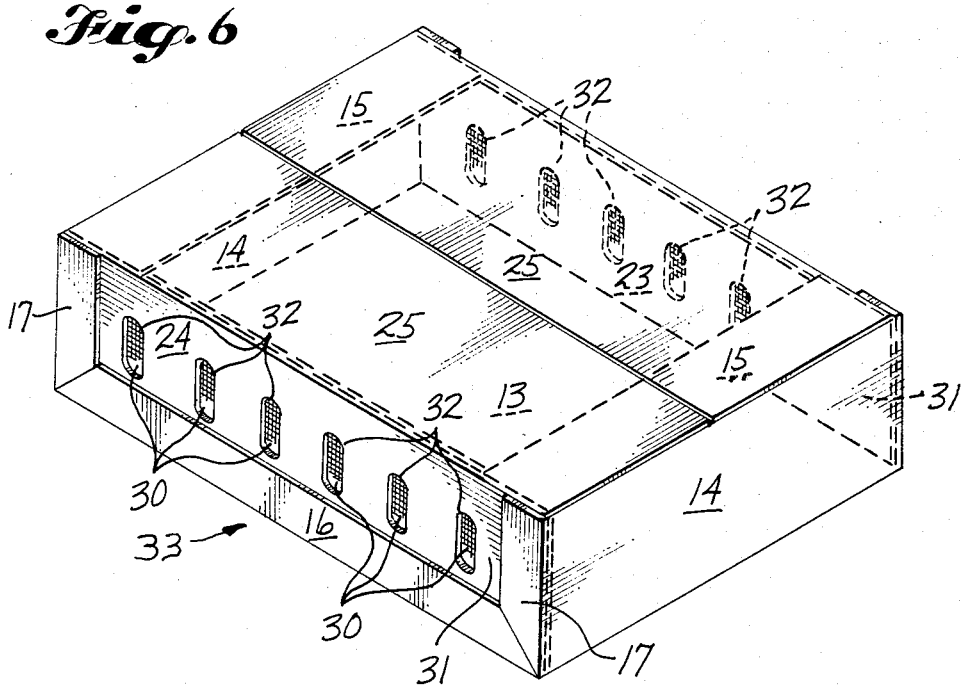
FIG. 6 is an isometric view of the enclosed container.

FIG. 4 shows the screen wire 30 attached to the outer side wall 24 and the inner side wall 23 being folded over and adhered to the inner face of the outer side wall 24 to form a laminated second side wall 31 having vent holes 32 covered by the screen wire 30.

The laminated second side wall 31 is then attached to the attachment flaps 16 and 17 of the body blank as shown in FIG. 5 to form container 33. An apparatus for doing this is disclosed in Roesner, et al U.S. Pat. No. 3,416,789 granted Dec. 16, 1968 and U.S. Pat. No. Re 27,825 granted Dec. 4, 1973.

Figure 7:
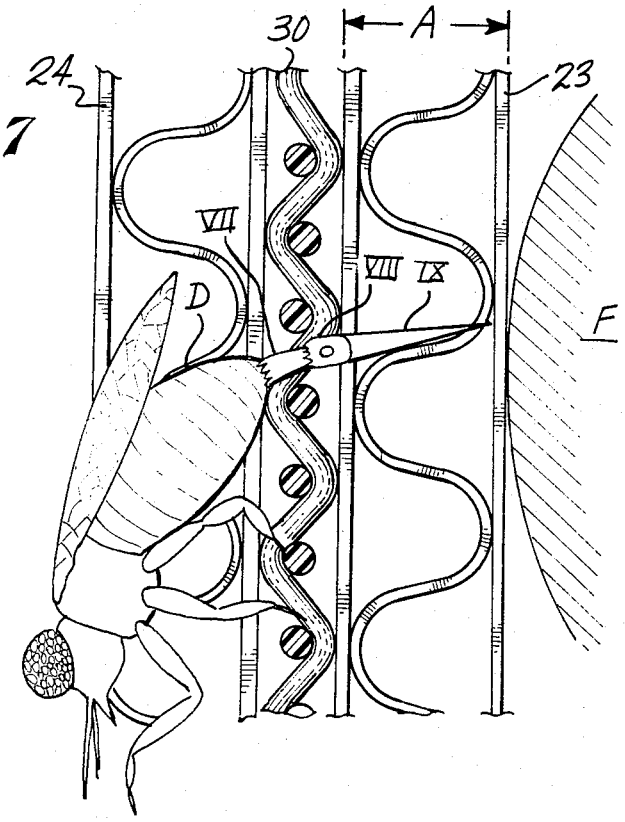
FIG. 7 is a cross-sectional view showing how the screen wire and inner lamination prevent the fly from depositing eggs in the fruit.

When the container 33 is filled with fruit and closed, the only access to the fruit is through the screened vent holes 32. As shown in FIG. 7, the depth A of the corrugated board forming the inner lamination in conjunction with the width of the vent hole will prevent the ovipositor of the insect from penetrating the fruit F and the mesh of the screen wire will be small enough to prevent the abdomen D of the insect to pass through the openings of the screen. Consequently, as shown in FIG. 7, the ovipositor will not attach by barbs or penetrate the fruit F in the container.

The screen should be a fiberglass window screen having a maximum mesh size of 16 mesh.

An A-flute corrugated board, which has a depth "A" of 3/16 inches plus the depth of the facings, will prevent the ovipositor of the fly from penetrating the fruit. The inner side wall may also be formed of laminations of board in order to obtain the required thickness.

The vent holes 32 should be narrower than usual in order to prevent the screen wire from sagging too close to the fruit. Several size vent holes have been tried. The size and number of holes will depend on the size of the box. The size of the box will vary from one type of fruit to another. For example, a papaya box would be 5 inches deep, $13\frac{3}{4}$ inches wide, and $19\frac{1}{2}$ inches long, and an avocade box would be $6\frac{7}{8}$ inches deep, $12\frac{1}{2}$ inches wide, and $16\frac{1}{2}$ inches long. Consequently, there may be between four and eight vent holes in the sides of the container. Papaya containers made from A flute with $6\frac{1}{4}$ inch wide×2 inches high vent holes and avocado containers with 4 and 6 5/16 inch wide×3 inch high vent holes have been tested. A $\frac{3}{8}$ inch wide and $\frac{1}{2}$ inch wide vent hole has been tested. To the inventor's suprise, there was no penetration even with $\frac{1}{2}$ inch wide vent holes.

C flute which has a depth of 9/64 inch plus the depth of the facings is being tested and it is believed that it will be effective at the $\frac{1}{2}$ inch or less width of the vent hole.

The invention is described in conjunction with a three-piece bliss container. It may be recognized that any container with laminated side walls may be used. An example would be the container showed in the Putnam U.S. Pat. No. 3,940,053 noted earlier, or any regular slotted container having an interior laminated liner. This construction will allow vent holes to be placed in all side panels.

Although this discussion has emphasized fruit and fruit flies, this is not the only type of produce that has this problem or type of insect that causes this problem.

The fruit and fruit fly should be considered as exemplary only.

I claim:

1. A container for preventing insects from depositing eggs in produce contained therein comprising
two pair of opposed side panels,
a bottom panel,
a cover,
one of said panels being formed of two layers of corrugated board,
a plurality of vent holes in said one panel,
a screen between said panel layers and covering said vent holes, to prevent access to the interior of said container
said inner panel layer being of a thickness, each of said vent holes having a width and the mesh of said screen being of a size whereby said produce will be a distance from said screen which prevents an insect from depositing eggs in said produce within said container.

2. The container of claim 1 in which said one panel is formed separately from said other panels of the container body and is attached to said other container body panels by attached flaps.

3. The container of claim 1 in which said screen has a maximum size of 16 mesh.

4. The container of claim 1 in which the inner layer of said one panel has a minimum depth equivalent to A-flute.

5. The container of claim 1 in which the inner layer of said one panel has a minimum depth equivalent to C-flute.

6. The container of claim 1 in which
one of the pair of opposed panels are formed of two layers of corrugated board, and
said vent holes and said screen are in said pair of two layer panels.

7. The container of claim 6 in which said pair of two layer panels are formed separately from said other panels of the container body and are attached to said other container body panels by attached flaps.

8. The container of claim 6 in which said screen has a maximum size of 16 mesh.

9. The container of claim 6 in which said inner layer of said pair of laminated panels has a minimum depth equivalent to A-flute.

10. The container of claim 6 in which the inner layer of said pair of laminated panels has a minimum depth equivalent to C-flute.

11. The container of claim 1 in which said one panel is formed separately from said other panels of the container body and is attached to said other container body panels by attached flaps.

12. The container of claim 1 in which said screen has a maximum size of 16 mesh.

13. The container of claim 1 in which the inner layer of said laminated panel has a minimum depth equivalent to A-flute.

14. The container of claim 1 in which the inner layer of said laminated panel has a minimum depth equivalent to C-flute.

15. The container of claim 1 in which
one of the pair of opposed panels are formed of two layers of corrugated board laminated together, and
said vent holes and said screen are in said pair of laminated panels.

16. The container of claim 15 in which said pair of laminated panels are formed separately from said other panels of the container body and are attached to said other container body panels by attached flaps.

17. The container of claim 15 in which said screen has a maximum size of 16 mesh.

18. The container of claim 15 in which said inner layer of said pair of laminated panels has a minimum depth equivalent to A-flute.

19. The container of claim 15 in which said inner layer of said pair of laminated panels has a minimum depth equivalent to C-flute.

20. The container of claim 2 in which said attached flaps are on the outside of said one panel.

21. The container of claim 7 in which said attached flaps are on the outside of said pair of two layer panels.

22. The container of claim 1 in which said two layers of corrugated board are laminated together.

23. The container of claim 11 in which said attached flaps are on the outside of said one panel.

24. The container of claim 16 in which said attached flaps are on the outside of said pair of laminated panels.

* * * * *

UNITED STATES PATENT AND TRADEMARK OFFICE

CERTIFICATE OF CORRECTION

PATENT NO. : 4,513,907

DATED : April 30, 1985

INVENTOR(S) : Lee V. Grosshuesch

It is certified that error appears in the above—identified patent and that said Letters Patent is hereby corrected as shown below:

In column 2, line 3, "pat" should read --part--;

In column 6, line 7, "claim 1" should read --claim 22--;

In column 6, line 11, "claim 1" should read --claim 22--;

In column 6, line 13, "claim 1" should read --claim 22--;

In column 6, line 16, "claim 1" should read --claim 22--;

In column 6, line 19, claim 1" should read --claim 22--;

Signed and Sealed this

*Third* Day of *September 1985*

[SEAL]

*Attest:*

DONALD J. QUIGG

*Attesting Officer* *Acting Commissioner of Patents and Trademarks - Designate*